US006517397B1

(12) United States Patent
Gohara et al.

(10) Patent No.: US 6,517,397 B1
(45) Date of Patent: Feb. 11, 2003

(54) AIR INDUCTION SYSTEM FOR SMALL WATERCRAFT

(75) Inventors: Yoshihiro Gohara, Shizuoka (JP); Yoshihide Fukuda, Shizuoka (JP); Tetsuya Ishino, Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/669,484

(22) Filed: Sep. 25, 2000

(30) Foreign Application Priority Data

Sep. 24, 1999 (JP) ..... 11-271063

(51) Int. Cl.[7] ..... B63H 21/10
(52) U.S. Cl. ..... 440/88; 114/55.5
(58) Field of Search ..... 440/88, 89, 38; 114/55.5; 123/198 A, 193.1, 193.2

(56) References Cited

U.S. PATENT DOCUMENTS

| | | | | |
|---|---|---|---|---|
| 4,300,488 | A | 11/1981 | Cser | |
| 4,353,211 | A | 10/1982 | Cser et al. | |
| 4,538,556 | A | 9/1985 | Takeda | |
| 4,678,441 | A | 7/1987 | Murase | |
| 4,738,229 | A | 4/1988 | Wada et al. | |
| 4,989,409 | A | 2/1991 | Nakase et al. | |
| 5,002,021 | A | 3/1991 | Nakata et al. | |
| 5,014,816 | A | 5/1991 | Dear et al. | |
| 5,088,454 | A | 2/1992 | Washizu et al. | |
| 5,234,364 | A | 8/1993 | Ito | 440/89 |
| 5,377,629 | A | 1/1995 | Brackett et al. | |
| 5,632,239 | A | 5/1997 | Patyi et al. | |
| 5,636,586 | A | 6/1997 | Suganuma | 114/183 R |
| 5,647,314 | A | 7/1997 | Matsumura et al. | |
| 5,827,096 | A | 10/1998 | Mineo | 440/89 |
| 5,881,664 | A | 3/1999 | Suganuma | 114/183 R |
| 5,960,770 | A | * 10/1999 | Taue et al. | 123/197.3 |
| 6,009,705 | A | 1/2000 | .Arnott et al. | 60/312 |
| 6,026,775 | A | 2/2000 | Yamane | 123/184.52 |
| 6,253,696 | B1 | * 7/2001 | Mashiko | 440/89 |

FOREIGN PATENT DOCUMENTS

| | | |
|---|---|---|
| JP | 2-215925 A | 8/1990 |
| JP | 2-241966 A | 9/1990 |

OTHER PUBLICATIONS

Parts Catalogue, Model Year 1999 XL 1200L TD XA 1200X (F0D1), 6 pages.
French article entitled *Brevet D'Invention*, number 1, 263.608, 6 pages.

* cited by examiner

*Primary Examiner*—Jesus D. Sotelo
(74) *Attorney, Agent, or Firm*—Knobbe, Martens, Olson & Bear, LLP

(57) ABSTRACT

An induction system for a watercraft includes a first intake air chamber communicating with at least one combustion chamber of an engine of the watercraft, and a second intake air chamber communicating with the first intake air chamber via a conduit. The second intake air chamber may be arranged in various orientations and/or with various other features which improve attenuation of induction noises and/or the preclusion of water from entering the engine through the induction system.

22 Claims, 9 Drawing Sheets

AIR INDUCTION SYSTEM FOR SMALL WATERCRAFT

PRIORITY INFORMATION

This application is based on Japanese Patent Application No. 11-271063 filed Sep. 24, 1999.

BACKGROUND OF THE INVENTION

1. Field of the Invention

The present invention is directed to a watercraft, and more particularly to a water preclusion and sound attenuation system employed in a watercraft engine induction system.

2. Description of the Related Art

Personal watercraft have become increasingly popular in recent years. This type of watercraft is sporting in nature; it turns swiftly, it is easily maneuverable, and accelerates quickly. A personal watercraft today commonly carries one rider and up to three passengers. Typically, the rider and passengers sit on a straddle-type seat that is formed by the hull of the watercraft. The straddle-type seat is generally aligned by the longitudinal axis of the hull.

The space beneath the straddle-type seat is usually used as an engine compartment for supporting the engine within the watercraft. The engine is preferably arranged within the engine compartment so that the crankshaft of the engine is aligned with the longitudinal axis of the watercraft. With the engine arranged as such, the crankshaft of the engine may be directly connected to an output shaft for driving a propulsion unit. Additionally, such an arrangement allows the engine to be arranged within the seat pedestal. Arranged as such, the engine and the seat pedestal form a compact unit. During operation, the rider and any passengers straddle the seat as well as the engine while they are seated on the straddle-type seat. With the hull shaped as such, the engine is in close spacing with the passengers during operation, thus allowing the overall size of the watercraft to remain quite small, resulting in a compact and highly maneuverable watercraft.

Although these watercraft are generally highly maneuverable and are used in a sporting manner, there is an interest in reducing the noise generated by this type of watercraft. One part of the watercraft propulsion system that can generate noise is the induction system of the engine. For the most part, the induction systems used for this type of watercraft have been designed primarily to ensure adequate air induction and at least some filtration of the inducted air. Little effort has been given, however, to the silencing of the induction system.

At least partially in response to the noise generated by two-cycle engines, which are commonly employed in personal watercraft, certain recreational facilities have banned the operation of two-cycle engine powered watercraft. Such bans have resulted in a decrease in popularity of personal watercraft powered by two-cycle engines.

Obviously, it is necessary for the induction system to be able to ingest an adequate flow of air for maximum engine performance. In many instances, the induction systems previously proposed for watercraft have not recognized the advantages of using a tuning arrangement on the intake side of the engine. One reason for this is that the space available in an engine compartment of a personal watercraft generally does not afford room for various types of intake tuning systems. Although it has been known that a large intake air box will prevent the generation of loud noises in the induction system and will generate a smooth flow of air into the combustion chambers, the small space available in the hulls of small watercraft have prevented the use of large air boxes.

For example, a large air box mounted so as to feed the intake runners arranged along one side of an engine within the engine compartment of a watercraft, will tend to attenuate induction noises. However, as discussed above, engines are preferably arranged within the engine compartments of personal watercraft such that their crankshaft is aligned with the longitudinal axis of the watercraft. As such, the intake runners open at a side of the engine, facing an inner wall of the seat pedestal. Therefore, the size of the intake air box affects the overall width of the engine. If a large intake air box is used, the overall width of the engine is increased.

Since the rider and any passengers straddle the seat pedestal and engine during operation, the overall width of the engine is limited to that which would fit within a straddle-type seat pedestal. If the pedestal is too wide, a rider cannot comfortably sit on the seat pedestal during operation of the watercraft. Therefore, any portions of the engine mounted along either side of the engine, such as the induction system, should be small enough such that the engine can still fit within the seat pedestal that defines an engine compartment of the watercraft.

Additionally, because of its sporting nature, personal watercraft are oftentimes laid on their side or are flipped over by advanced riders during use. It thus is also important that the induction system be designed in such a way to inhibit water, which may be present in the engine compartment, from passing into the engine through the induction system.

SUMMARY OF THE INVENTION

According to one aspect of the present invention, an engine induction system for a watercraft includes a first intake air chamber having an air inlet and communicating with the at least one combustion chamber and a second intake air chamber having an air inlet and an air outlet. A conduit connects the air inlet of the first intake air chamber to the outlet of the second intake air chamber. The outlet of the second intake air chamber is positioned vertically lower than the inlet of the first intake air chamber.

By positioning the outlet of the second intake air chamber vertically lower than the inlet of the first intake air chamber, the present induction system aids in preventing water from passing into the engine through the induction system. For example, as noted above, small watercraft, such as personal watercraft, are sporting in nature, and are oftentimes driven rigorously. Water can enter the engine compartment of these watercraft in several ways. In particular, water can enter the engine compartment through air vents that allow atmospheric air to enter the engine compartment so as to feed air to the engine for combustion. Water may also enter the engine compartment through leaks that may inadvertently occur. Finally, water may enter the engine compartment when an access opening of the engine compartment is open. Thus, when the watercraft is operated in a normal fashion, the water in the engine compartment can splash vigorously therein. However, by positioning the outlet of the second intake air chamber vertically lower than the inlet of the first intake air chamber, it is more difficult for such water to pass into the engine, where the damaging and corrosive effects of water can cause significant damage requiring expensive repairs.

According to another aspect of the present invention, an engine induction system for a watercraft includes a first intake air chamber having an air inlet and communicating with the at least one combustion chamber and a second intake air chamber having an air inlet and an air outlet. A conduit connects the air inlet of the first intake air chamber to the outlet of the second intake air chamber. The conduit is sized so as to form a third air chamber. Preferably, the cross-sectional flow area of the conduit is larger than the outlet of the second intake air chamber and the inlet of the first intake air chamber. As such, the present induction system causes air flowing therethrough to contract and expand several times before entering the engine. The expansion and contraction of the air flow through the induction system quiets and smoothes the air before it enters the engine.

According to another aspect of the present invention, an engine induction system for a watercraft includes a first intake air chamber having an air inlet and communicating with the at least one combustion chamber and a second intake air chamber having an air inlet and an air outlet. A conduit connects the air inlet of the first intake air chamber to the outlet of the second intake air chamber and a branched conduit extends upwardly from the conduit. As such, the branched conduit provides a water preclusive effect when the watercraft is capsized.

For example, as noted above, personal watercraft are oftentimes capsized during normal operation. Thus, water that may be present in the engine compartment of the watercraft can flow upstream through an air induction system as the watercraft rotates toward and reaches a capsized positioned. By providing an upwardly extending branched passage from the conduit, water that travels through the conduit when the watercraft is capsized, can flow into the branched passage. Additionally, when the watercraft is returned to an upright position, the water collected in the upwardly extending passage will drain back to the conduit, thus ejecting water that had previously flowed upstream into the induction system.

Further aspects, features and advantages of the present invention will become apparent from the detailed description of the preferred embodiment which follows.

BRIEF DESCRIPTION OF THE DRAWINGS

The above-mentioned and other features of the invention will now be described with reference to the drawings of a preferred embodiment of the present watercraft. The illustrated embodiment is intended to illustrate, but not to limit the invention. The drawings contain the following figures.

DETAILED DESCRIPTION OF THE PREFERRED EMBODIMENT

Figure 1:
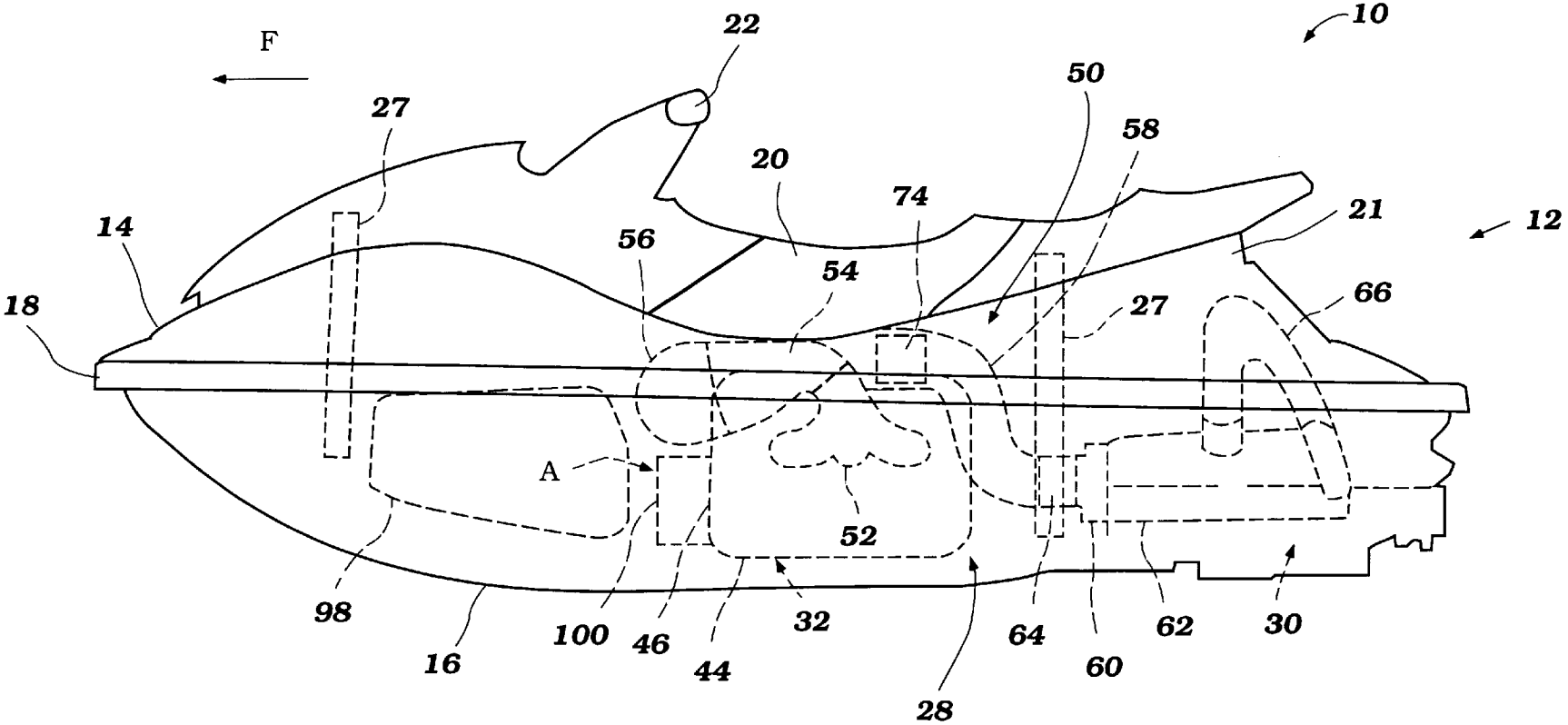
FIG. 1 is a side elevational view of a personal watercraft in accordance with a preferred embodiment of the present invention with several internal components of the watercraft (e.g. an engine) shown in phantom line.
Figure 2:
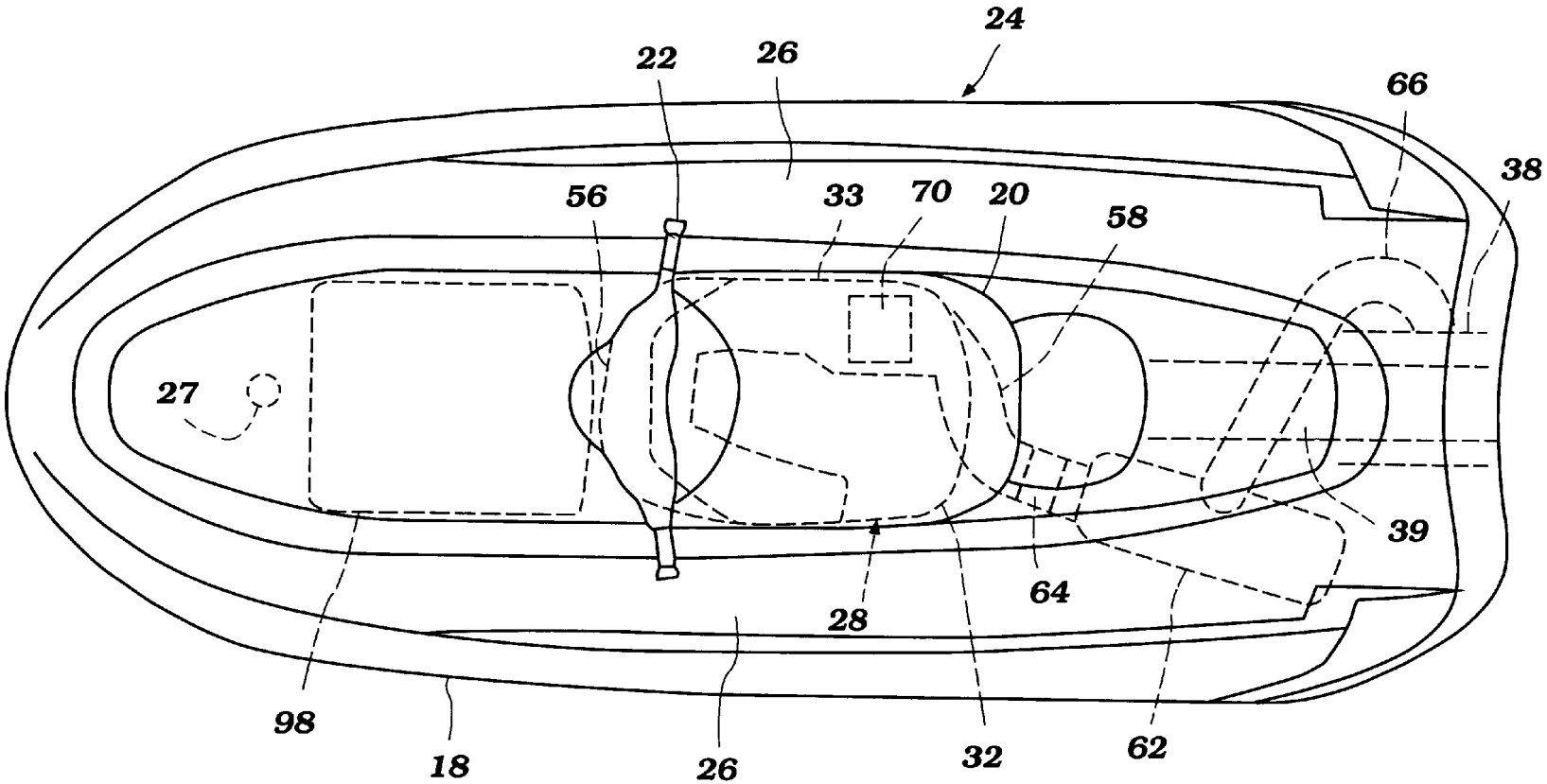
FIG. 2 is a top plan view of the personal watercraft shown in FIG. 1, with certain internal components represented in phantom line.

FIGS. 1 and 2 illustrate different views of a small watercraft incorporating an induction system configured in accordance with the preferred embodiment of the present invention. The induction system includes enhanced noise attenuation and/or water preclusion characteristics, and effectively utilizes space that is typically unused within a hull of a watercraft. Although the present induction system is illustrated in connection with the personal watercraft, the illustrated induction system can be used with other types of watercraft as well, such as, for example, but without limitation, small jet boats and the like.

FIGS. 1 and 2 illustrate a watercraft 10 having a watercraft body comprising a hull 12 which is constructed of a top portion or deck 14 and a lower portion 16. A gunnel 18 defines a intersection of the lower portion 16 and the deck 14 of the hull 12. The watercraft 10 is suited for movement through a body of water in a direction F (towards the front end of the watercraft).

A seat 20 is positioned on a seat pedestal 21 which is formed by the deck 14 of the hull 12. A steering handle 22 is provided adjacent the seat 20 for use by a user in directing the watercraft 10. Preferably, a bulwark 24 is defined by the gunnel 18 and extends upwardly along each side of the watercraft 10. A footstep area 26 is defined between the seat 20 and the bulwark 24 on each side of the watercraft 10.

Figure 3:
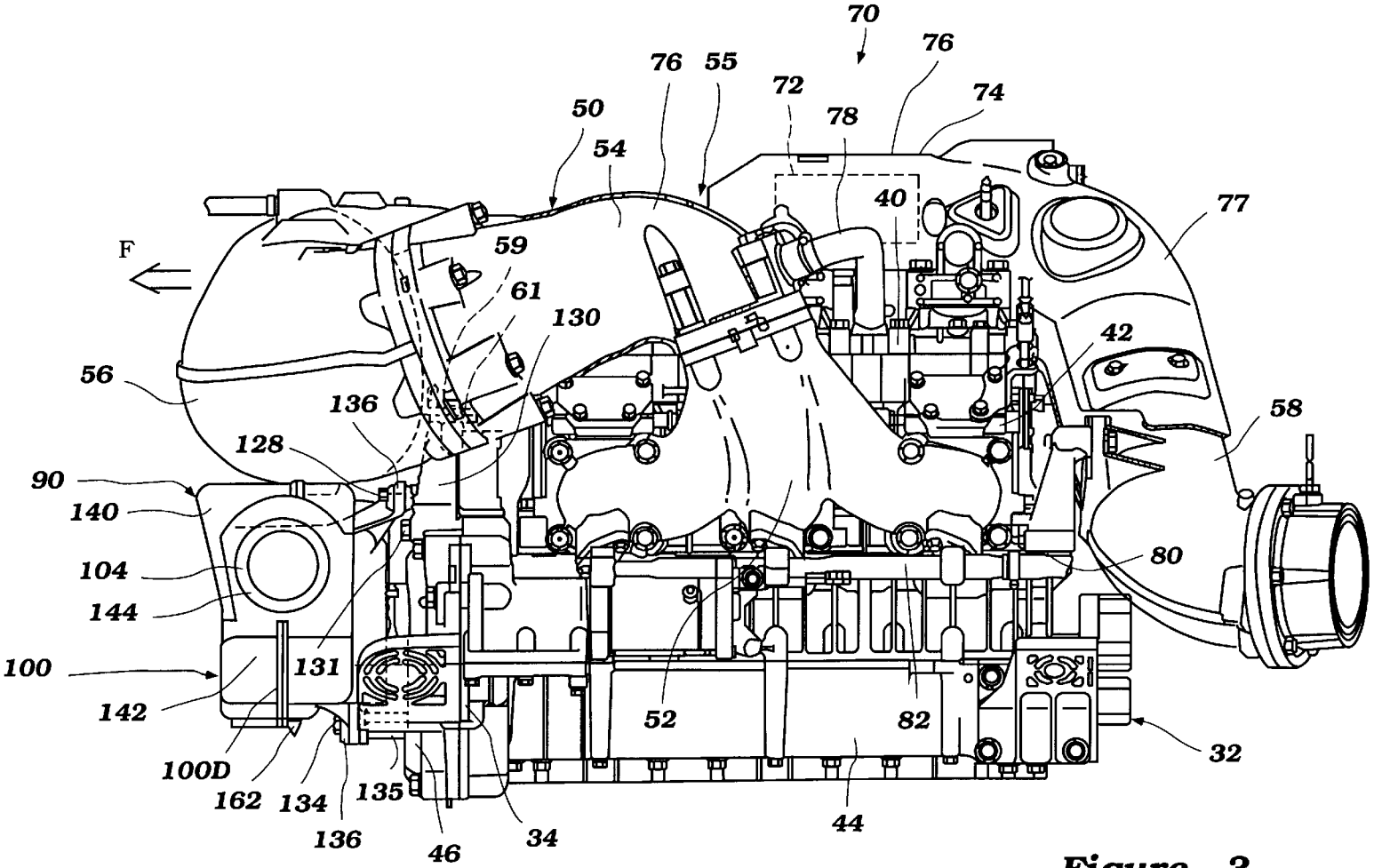
FIG. 3 is a side elevational view of the engine of the personal watercraft shown in FIG. 1.

The top and bottom portions 14 and 16, along with a bulkhead (not shown) define an engine compartment 28 and a pumping or propulsion unit compartment 30. An engine 32 is positioned in the engine compartment 28. With reference to FIG. 3, the engine 32 is connected to the lower portion 16 of hull 12 with several engine mounts (not shown) which are shaped to be bolted to the lower portion 16 of hull 12 or to an insert (not shown) attached to the hull lower portion 16.

The engine 32 is preferably at least partially accessible through a maintenance opening 33, which itself is accessible by removing the seat 20. As shown in FIG. 1, the hull 12 also includes at least one intake air vent 27, which allows air to enter the engine compartment 28. Preferably, the hull 12 includes two intake air vents 27, provided at the front and rear of the hull 12, which allow air to flow through the engine compartment 28.

The engine 32 has a crankshaft (not shown) which is located at least partially within a crankcase 44, and which is connected to a flywheel (not shown) in a known manner. As shown in FIG. 1, the engine 32 includes flywheel cover 46 arranged at a forward end of the crankcase 44 of the engine 32.

The engine 32 transfers rotational energy from the crankshaft to a propulsion unit 39 provided in the propulsion unit compartment 30. The propulsion unit 39 is provided in a tunnel 38 formed in the lower portion 16 of the hull 12. Arranged as such, the propulsion unit 39 induces a flow of water into an inlet of the tunnel 38 and out a rear outlet of the tunnel 38 to thereby propel the watercraft 10 in a known manner.

The engine 32 preferably has two or three cylinders arranged in-line and operates on a two-cycle, crankcase compression principle. Of course, the engine 32 may have one, two, or more than three cylinders, as may be appreciated by one skilled in the art, arranged in different cylinder orientations, as well as may operate in accordance with other combustion principles (e.g., 4-cycle, diesel, and rotary principles).

Figure 4:
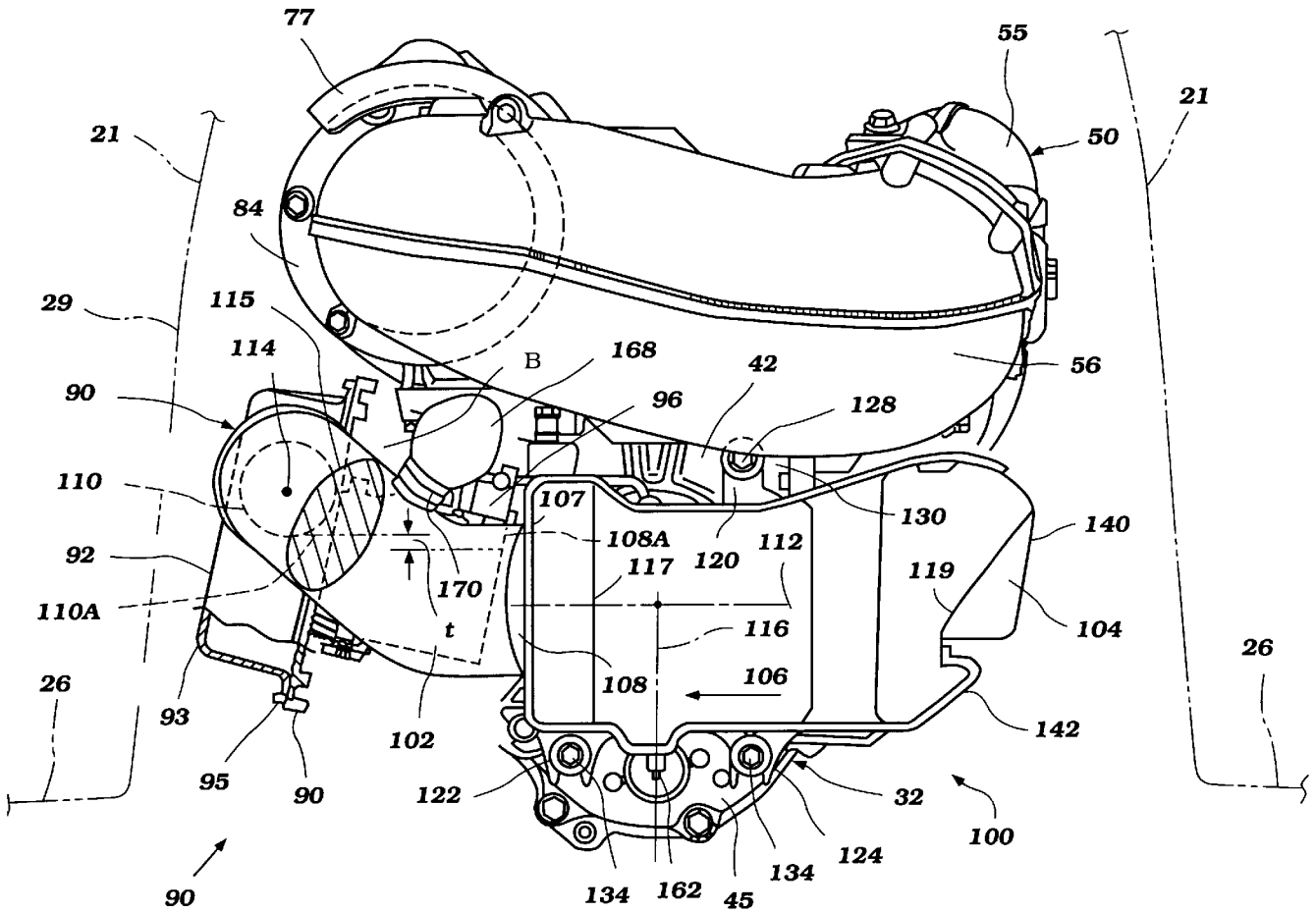
FIG. 4 is a front elevational view of the engine shown in FIG. 3, illustrating intake air chambers connected by a conduit and a resonator chamber connected to the conduit, with portions of the surrounding hull shown in phantom.
Figure 5:
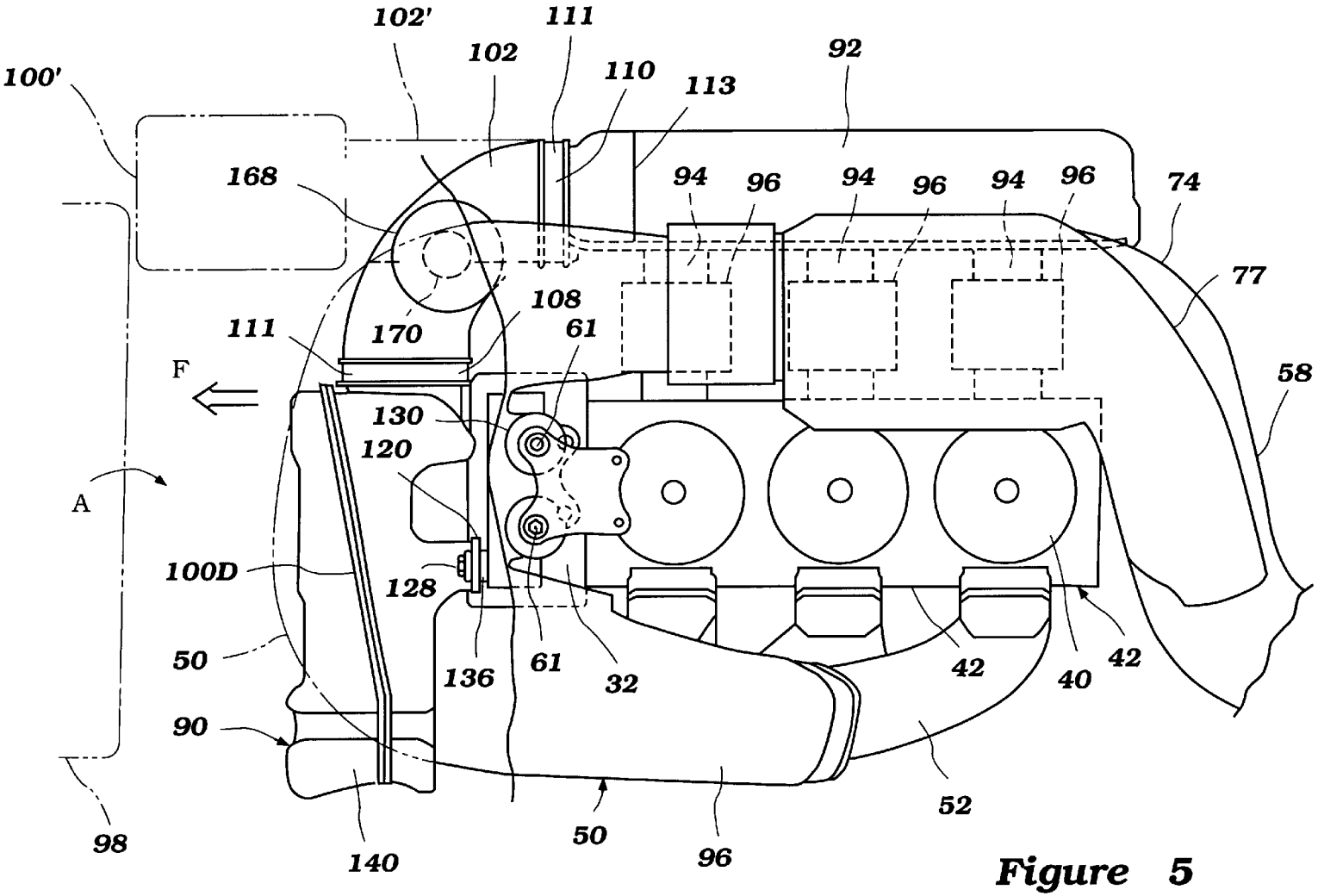
FIG. 5 is a top plan view of the engine shown in FIG. 4.

With reference to FIGS. 3–5, the engine 32 includes a cylinder head 40 that is mounted to a cylinder block 42 and cooperates therewith to define the three cylinders. A piston (not shown) is movably mounted in each cylinder and is connected to the crankshaft via a connecting rod, in a well known manner. The piston cooperates with the cylinder head 40 and a cylinder block 42 so as to define a combustion chamber portion of each cylinder.

In order to process exhaust gases discharged from the engine 32, the watercraft 10 includes an exhaust system 50. As shown in FIG. 1, the exhaust system 50 includes an exhaust manifold 52 for directing the exhaust gases discharged from each of the cylinders of the engine 32 into an inlet pipe 55 forming a diverging portion 54 of an expansion chamber 56. As shown in FIGS. 1 and 2, the expansion chamber 56 is connected to a down-turned portion 58 which then passes through a bulkhead (not shown). As shown in FIG. 3, the expansion chamber 56 is preferably supported by the engine 32 via an L-shaped metal bracket 59 fastened to a stay 130 with bolts 61.

With reference to FIGS. 1 and 2, at approximately the position of the bulkhead (not shown), the down-turned portion 58 is connected to an inlet 60 of a watertrap device 62 via a flexible connector 64 such as a rubber hose. A discharge pipe 66 extends from the water trap device 62, over the tunnel 38, and terminates in a wall of the tunnel 38 at a position preferably at or slightly beneath the waterline of the watercraft 10.

In light of the recent environmental concerns raised with respect to two-cycle engine powered watercraft, the exhaust system 50 preferably includes a catalytic device 70 for removing and/or further combusting undesirable exhaust byproducts. With reference to FIG. 3, the catalytic device 70 preferably includes a catalytic bed 72 provided within a second expansion chamber 74. In order to control the temperature of the exhaust system, the exhaust system includes a cooling jacket 76 formed around the portion of the exhaust system 50 that is arranged within the engine compartment 28.

For example, the cooling jacket 76 is in thermal contact with the diverging portion 54, the expansion chamber 56 which forms a first expansion chamber, the converging portion 57, the second expansion chamber 74, and the down-turned portion 58. The cooling jacket 76 is fed a coolant, such as water, from the engine 32 via pipe 78 which is connected to a cooling jacket formed around the cylinders of engine 32. The engine 32 is supplied with coolant from an outside source, such as water from a jet pump provided in the propulsion unit 39 via inlet 80 of coolant delivery pipe 82, in a well known manner. Additionally, in order to connect the cooling jacket 76 around the first expansion chamber 56 with the coolant jacket around the second expansion chamber 74, a coupling 84 is provided between the first expansion chamber 56 and the second expansion chamber 74 so as to fluidly connect the portion of water-jacket 76 provided around first expansion chamber 56 with the portion of the cooling jacket 76 providing around the second expansion chamber 74. In order to protect the cylinder head 40 from the heat discharged from the second expansion chamber 74 and the down-turned portion 58 of the exhaust system, a heat shield 77 is preferably provided around at least a portion of the second expansion chamber 74 and the down-turned portion 58, as shown in FIGS. 3–5.

With reference to FIGS. 1–5, and in particular FIGS. 3–5, the induction system 90 includes a first intake air chamber 92. Preferably, the first intake air chamber 92 is formed of a body member 91 connected to intake runners 94, and a cover member 93 sealedly engaged with the body member 91 along a sealing surface 95. As shown in FIG. 4, a dead space B is formed above the charge formers 96, between the intake air chamber 92 and the engine 32, and below the coupling 84. The first intake air chamber 92 communicates with at least one combustion chamber formed in the cylinder head 40 through the intake runners 94 in a known manner.

For example, the intake runners 94 direct air into corresponding fuel charge formers 96 which mix air from the intake runners 94 with a charge of fuel for delivery into the combustion chambers of the cylinder head 40. Although fuel injectors are preferred, carburetors and other known devices may also be used as the fuel charge formers 96. Although it is desirable to form the first intake air chamber 92 so as to be as large as possible so as to reduce induction system noise, space within the watercraft hull 12 is limited.

For example, is as shown in FIG. 4, if the width of the first intake air chamber 92 is increased, a side wall 29 of the seat pedestal 21, which also forms a side wall of the engine compartment, would have to be moved outward so as to accommodate a larger first intake chamber. Additionally, a gap should be formed between the intake chamber 92 and the wall 29 so as to accommodate engine vibration relative to the wall 29, and to avoid conduction of vibration from the engine 32 to wall 29.

The induction system 90 includes a second intake air chamber 100 communicating with the first intake air chamber 92 via a conduit 102. As shown in FIGS. 4 and 5, the intake air chamber 100 includes an inlet orifice 104 which is open to the engine compartment. The chamber 100 communicates with the conduit 102 through an outlet 108 formed in a side wall 107 of the chamber 100.

With reference to FIG. 5, the conduit 102, at a downstream end in the direction of air flow, is connected to an inlet 110 of the first intake air chamber 92. The conduit 102 preferably is constructed of a flexible material such as rubber, and is connected to the outlet 108 and the inlet 110 with band clamps 111.

In operation, ambient air from the engine compartment 28 enters the induction system 90 via the inlet 104. Air then flows through the chamber 100 in the direction of arrow 106 until it reaches an outlet 108. The flow of induction air enters the conduit 102 through the outlet 108 of the chamber and continues to the inlet 110 of the air intake chamber 92. As the air flow passes through the chamber 92, the air flow is distributed to the intake runners 94.

Constructed as such, the second intake air chamber 100, the conduit 102, and the first intake air chamber 92 define an induction air flow path for air entering the engine 32 for combustion purposes. Furthermore, by constructing the induction system 90 in the form of a first chamber connected to a second chamber by a conduit, the induction system 90 provides for the efficient use of the relatively small amount of space available in a small watercraft.

For example, as is illustrated in FIG. 4, the engine compartment 28 is nearly completely filled by the engine 32. The width of the engine 32 is nearly as wide as the engine compartment 28, along a direction transverse to the longitudinal direction of the watercraft 10. Additionally, as shown in FIG. 5, the engine 32 is in close proximity to the fuel tank 98. Because the engine compartment 28 is positioned generally below the seat 20, the maximum width of the engine compartment 28 is quite limited. For example, since the passengers of the watercraft 10 sit directly above the engine 32, and on the seat 20 in a straddle-type fashion, the width of the engine compartment 28 is limited to that which is appropriate for a width of a straddle-type seat assembly such as the seat 20. Therefore, by providing the induction system 90 with a first intake air chamber 92 and a second intake air chamber 100, which communicate with each other so as to define an induction air flow path, the present induction system 90 allows the second intake air chamber 100 to be arranged remotely from the first intake air chamber 92, thusly efficiently using the space available within the engine compartment 28.

The second intake air chamber 100 is preferably mounted between the engine 32 and the fuel tank 98, as shown in FIGS. 1 and 5. Arranged as such, the induction system 90 utilizes a space which has heretofore gone unused win the hulls of known personal watercraft.

As shown in FIG. 4, the outlet 108 of the intake air chamber 100 has a center line 112 defining a center of the outlet 108. Additionally, the inlet 110 includes a center 114 which lies on a centerline of the inlet 110. As shown in FIG. 4, the center 114 of the inlet 110 is provided at an elevation higher than an elevation of center line 112 of outlet 108. Therefore, if water inadvertently enters the intake air chamber 100, it is unlikely that such water can flow upwards through the conduit 102 into the intake air chamber 92.

With reference to FIG. 4, in accordance with an aspect of the present invention, a lower edge 110A of the inlet 110 of the first intake chamber 92 is positioned vertically higher than an upper edge 108A of the outlet 108 of the second intake chamber 100. The lower edge 110A is vertically higher than the upper edge 108A by distance t.

By positioning the lower edge 110A of the inlet 110 above the upper edge 108A of the outlet 108, the present induction system 90 further ensures that water that may flow from the first air intake chamber 100 and through the outlet 108 does not reach the inlet 110 of the air intake chamber 92.

As shown in FIG. 4, the engine 32 has a center line 116 along which the crankshaft (not shown) and the flywheel (not shown) are aligned. Preferably, the inlet orifice 104 of the intake air chamber 100 is positioned so as to be on the side of the center line 116 that is opposite of the intake air chamber 92. However, the intake chamber 100 and the conduit 102 of the induction system 90 may be arranged as chamber 100' and conduit 102' as shown in FIG. 5. In either orientation, the chamber 100 or 100' are arranged between the engine 32 and the fuel tank 98. By positioning the intake air chamber 100 or 100' as such, the induction system 90 effectively utilizes a dead space A that has heretofore gone unused in the engine compartments of small watercraft such as personal watercraft.

With reference to FIGS. 4 and 5, the induction system 90 preferably defines an induction air flow path that contracts and expands along its length. For example, as shown in FIG. 5, the first intake air chamber 92 defines a maximum cross-sectional air flow area 113 that is defined along a plane generally perpendicular to the direction of air flow into the first intake air chamber 92. As shown in FIG. 4, the conduit 102 defines a cross-sectional flow area 115 which is smaller than the cross-sectional flow area 113.

The second intake air chamber 100 defines a maximum cross-sectional air flow area 117 along a plane generally perpendicular to the flow of air 106 through the second intake air chamber 106. The cross-sectional air flow area 117 preferably is larger than the cross-sectional air flow area 115. The inlet 104 similarly defines a cross-sectional air flow area 119 that is smaller than the cross-sectional air flow area 117.

In operation, a flow of air into the induction system 90 contracts and expands as it flows therethrough. For example, as air from the engine compartment 42 enters the inlet 104, the air flow accelerates as it passes through the cross-sectional air flow area 119. As the air flow moves past the cross-sectional air flow area 119 and through the cross-sectional air flow area 117, the air flow expands and therefore slows. As such, the air flow is quieted and smoothed by the contraction and expansion. Similarly, as the air flow leaves the second intake air chamber 100 and enters the conduit 102, the air flow is contracted and therefore accelerated, since the cross-sectional air flow area 115 of the conduit 102 is smaller than the cross-sectional air flow area 117. As the air flow exits the conduit 102 and enters the first intake air chamber 92, the cross-sectional air flow area of the air flow expands generally to the size and shape of the cross-sectional air flow 113 defined within the first intake air chamber 92. Accordingly, the air flow is expanded, thereby slowing the air flow which further quiets and smoothes the air flow.

With reference to FIG. 4, by positioning the second intake air chamber 100 so as to cross the centerline 116, the second air intake chamber 100 can be made longer. This is beneficial for the induction system 90 because if an inlet and an outlet of an air intake chamber such as the inlet 104 and outlet 108 of the air intake chamber 100, are positioned too closely, the air flow between the inlet 104 and the outlet 108 may not expand to the maximum cross-sectional area of the chamber, such as the cross-sectional area 117. However, by positioning the air intake chamber 100 so that it can be made longer, the inlet 104 and the outlet 108 can also be made larger without preventing the air flow therebetween from expanding to the maximum cross-sectional area 117.

Using a large outlet such as the outlet 108 on the air chamber 100, also accommodates the use of a large conduit such as the conduit 102 extending between the outlet 108 and the inlet 110. In the presently preferred embodiment, as illustrated in FIG. 4, the conduit 102 can be sized such that the conduit 102 itself forms a third intake air chamber. Preferably, the inner cross-sectional area 115 of the conduit 102 is larger than the cross-sectional area of the outlet 108 and the cross-sectional area of the inlet 110. Thus, the air flow also expands as it enters the conduit 102 and contracts as it passes through the inlet 110, thus further smoothing and silencing the air flow through the induction system 90.

Additionally, as shown in FIG. 5, at least a portion of the induction system 90 is configured so as to shield at least one of the charge forming devices 96 from being splashed with water. As is apparent from FIG. 5, with the fuel charge forming devices 96 arranged between the body of the engine 32 and the intake air chamber 92, the sides of the fuel charge forming devices are exposed and vulnerable to being splashed with water, which may be splashed within engine compartment 28 and towards the aft of watercraft 10. Therefore, by arranging at least part of the induction system 90 so as to shield at least one of the fuel charge forming devices 96 from being splashed with water, the induction system 90 aids in preventing the corrosive and damaging effects of water splashing on the fuel charge formers 96.

For example, water from the bodies of water in which watercraft 10 may be operated, and particularly sea water, causes accelerated corrosion of metals and rubber, as well as material used in gaskets provided between the fuel charge formers 96 and an intake manifold of the engine 32. However, with the conduit 102 and/or the intake air chamber 102 arranged on the exposed side of the fuel charge forming devices 96, the risk that water splashing in the engine compartment 28 may reach the fuel charge formers 96 is reduced. As shown in FIG. 5, the conduit 102 may be curved around the exposed side of fuel charge former 96, so as to at least partially surround the fuel charge former 96, thereby shielding the fuel charge former 96 from being splashed with water moving towards the aft of watercraft 10. Alternatively, the intake air chamber 100' and the conduit 102' may be arranged so as to create a shield for the exposed side of the fuel charge former 96, as shown in FIG. 5.

As is apparent from FIGS. 1 and 3–5, at least a portion of the exhaust system 50 preferably extends between the engine 32 and the fuel tank 98, generally above induction system 90. In this configuration, the total height of the engine is minimized.

As shown in the figures, although the upper edge 108A is positioned below the lower edge 110A, the induction system 90 defines a generally horizontal intake air flow path. The exhaust system 50, and in particular, the expansion chamber 56, extends generally parallel and above the induction system 90. Arranged as such, the exhaust system 50 and the induction system 90 cooperate to provide an effective shield against splashing water from reaching the fuel charge formers 90. Additionally, since the exhaust system 50, and particularly the expansion chamber 56, are quite hot during operation of the watercraft 10, water that is splashed on the exhaust passage 58 or the expansion chamber 56 is quickly vaporized, thereby preventing water from reaching the charge forming devices 96. Additionally, with the induction system 90 arranged below the exhaust passage 58, drips of water that may not have been vaporized by the exhaust passage 58, will be blocked from reaching the fuel charge formers 96, thereby reducing the likelihood that water may reach the fuel charge formers 96.

It has been found that users can be required to perform maintenance on the engine of a small watercraft, such as the watercraft 10, while the watercraft 10 is floating in a body of water. For example, sparkplugs of an engine, such as the engine 32, may become fouled during operation of the watercraft 10. Thus, in order to change the sparkplugs or restore them to an operational state, a user can remove the seat 20 from the seat pedestal 21 and remove sparkplugs (not shown) mounted to the cylinder head 40, while the watercraft 10 is floating on a body of water. However, it has been found that when the seat 20 is removed from the seat pedestal, thus opening the access opening 33, water from the body of water in which the watercraft 10 is operating, can splash into the access opening 33 and onto the engine 36. Additionally, the seat 20 may be wet when the user removes it from the seat pedestal 21. Accordingly, water may drip off of the seat 20 as the operator removes it from the access opening 33, further dripping water onto the engine 36. Thus, by arranging at least a portion of the exhaust system 50 over the induction system 90, the induction system 90 is further protected from dripping water. This is particularly advantageous because, with reference to FIGS. 7 and 8, the first intake air chamber is made from a front member 100A and rear member 100B each of which include sealing surfaces 100C which sealedly engage each other and form a seal 100D. With reference to FIG. 5, the seal 100D between the front and rear members 100A, 100B, is positioned beneath a portion of the exhaust system 50. As noted above, because the exhaust system is typically hot during operation of the watercraft 10, water droplets that may drip through the access opening 33 onto the exhaust system 50, are quickly vaporized. Thus, the exhaust system 50 further protects the seal 100D.

Although it has been known to provide a gap between an engine and fuel tank of a personal watercraft in order to prevent the overheating of fuel in the fuel tank, the volume of space generated in the gap has not been effectively used. Furthermore, due to the limited space available in engine compartments of small watercraft, little progress has been made in quieting the induction systems of engines provided in small watercraft. Therefore, by providing the induction system 90 with an intake air chamber such as the intake air chambers 100 or 100' provided between the engine 32 and the fuel tank 98, the induction system 90 achieves the dual goals of providing an additional intake air chamber for quieting the induction system 90 and effectively using a volume of dead space A in the engine compartment 28 which has heretofore gone unused.

Figure 10:
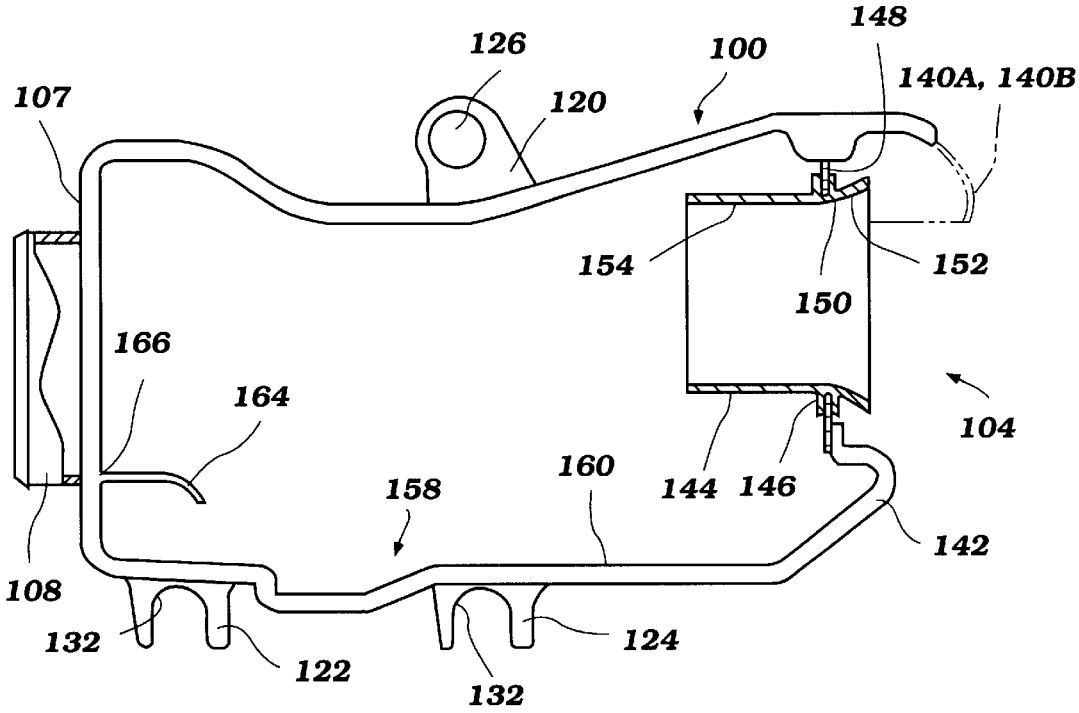
FIG. 10 is a partial sectional view of the intake air chamber shown in FIG. 9.
Figure 11:
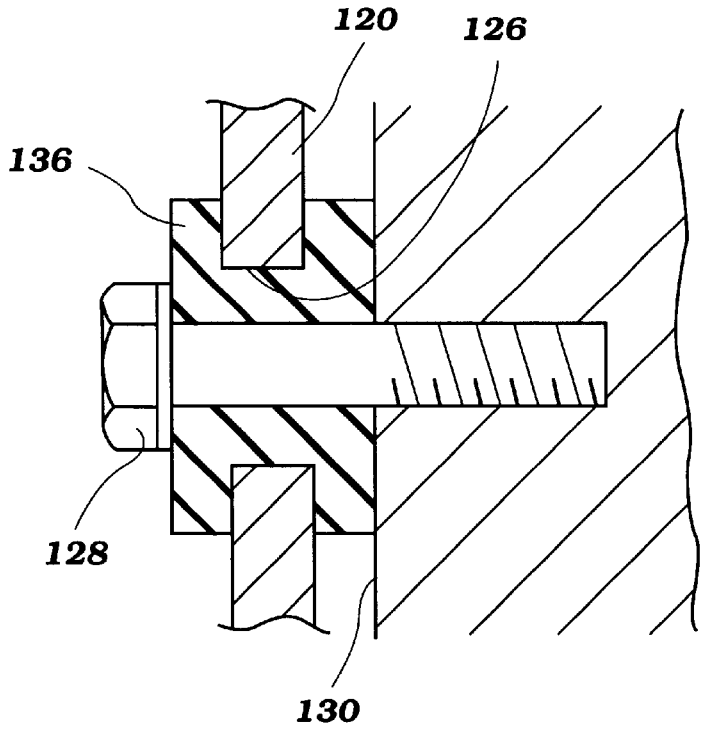
FIG. 11 is an enlarged cross-sectional view of a coupling between the engine and the intake air chamber shown in FIG. 3.

In a presently preferred embodiment, the intake air chamber 100 is mounted to the engine 32. For example, as shown in FIGS. 3–7, the intake air chamber 100 includes at least one bracket 120 for mounting the chamber 100 to the engine 32. Preferably, the chamber 100 includes a plurality of brackets 120, 122, 124 which are adapted to receive a fastener for securing the chamber 100 to the engine 32. For example, as shown in FIGS. 5 and 8, the bracket 120 includes a through hole 126 through which a bolt 128 passes in order to secure the bracket 120 to the stay 130. The stay 130 is mounted to the engine 32 with at least one bolt 131 and is preferably formed of a heat resistant material such as an aluminum alloy, for example. Alternatively, the brackets 120, 122 and 124 may have an alternate construction. For example, as shown in FIGS. 4, 10, and 11, the brackets 122 and 124 may include open slots 132 which are sized to receive threaded fasteners, such as bolts 134.

By mounting the intake air chamber 100 to the engine 32, several desirable advantages are achieved. For example, since it is common in the watercraft industry to assemble powerplants such as internal combustion engines, at sites remote from the site where final assembly of the engine with the watercraft is performed, special care and procedures should be taken to prevent damage, and during final assembly. Therefore, by mounting the intake air chamber 100 to the engine 32, the level of care required for ensuring that the intake air chamber 100 is not damaged during transportation is substantially reduced. Additionally, with the intake air chamber 100 mounted to the engine 32, no additional steps are required during assembly to mount the intake air chamber 100 to the hull 12.

Preferably, the intake air chamber 100 is mounted to the engine 32 via an elastic member such as grommets 136. The grommets are preferably formed of an elastic and heat resistant material such as rubber. Constructed as such, the grommets 136 and/or open slots 132 form vibration isolation couplings which attenuate vibration conducted to the intake air chamber 100 from the engine 32. By mounting the intake air chamber 100 to the engine 32 with such elastic members, several desirable advantages are achieved.

For example, by attenuating the vibration conducted to the intake air chamber 100 from the engine 32, additional noise that would be generated by the resonance of the walls of the intake air chamber 100 is avoided. Furthermore, if heat is allowed to be conducted into the intake air chamber 100, which would therefore be conducted into the air flowing into the induction system 90, the air may be undesirably expanded, thereby affecting the fuel-to-air ratio delivered to the combustion chambers of the engine 32. Therefore, by mounting intake air chamber 100 with elastic members 136 as such, undesirable noise and heat are avoided.

As shown in FIGS. 3 and 4, the bolts 134 may be secured to the flywheel cover 46 via a boss 135. By securing the bolts 134 as such, the complexity of the design of the cylinder head 40 can be simplified. For example, at any position on the cylinder head 40 where a threaded aperture is provided for receiving a threaded fastener such as a the bolts 134, it is advisable to ensure that a cooling jacket provided in the cylinder head 40 is not punctured during the machining of the threaded aperture. However, since the flywheel cover 46 provided on the lower portion of the engine 32 does not typically include a cooling jacket, it may not be as difficult to provide a threaded fastener on the flywheel cover 46 since there is no danger that a cooling jacket will be punctured.

Figure 6:
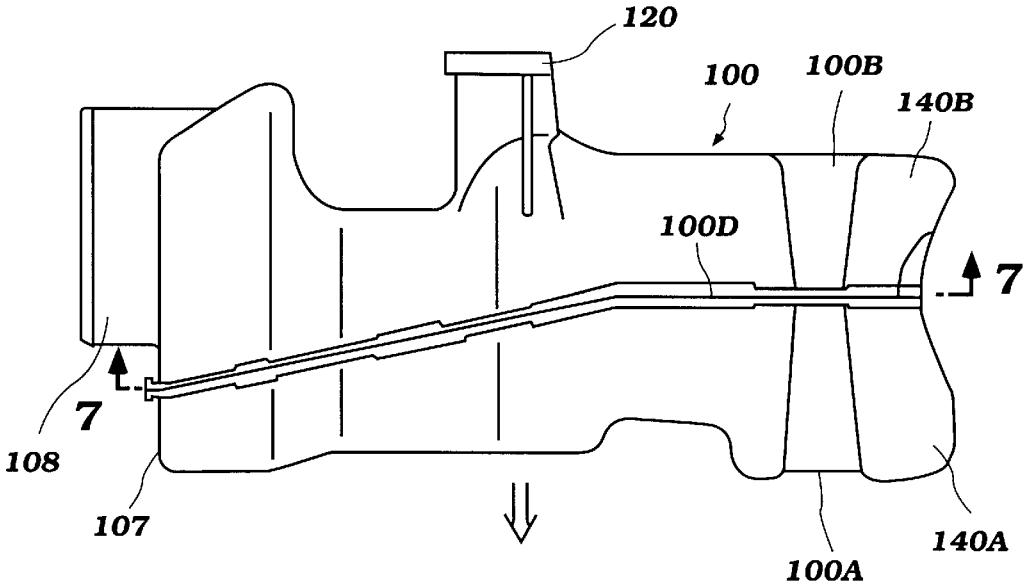
FIG. 6 is a top plan view of one of the air intake chambers shown in FIG. 4.
Figure 7:
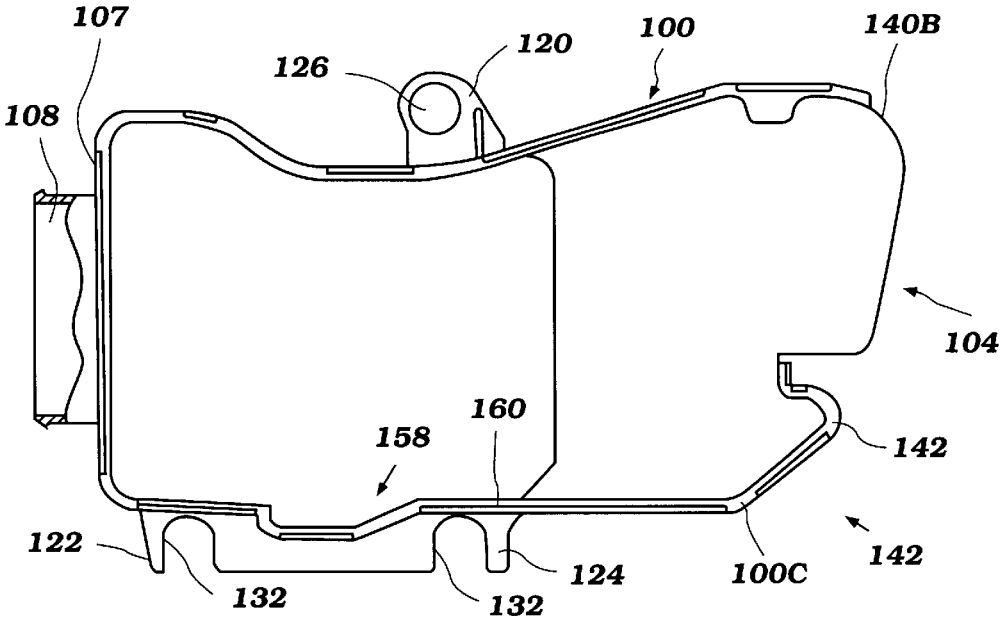
FIG. 7 is a sectional view of the air intake chamber shown in FIG. 4, taken along line 7—7.
Figure 8:
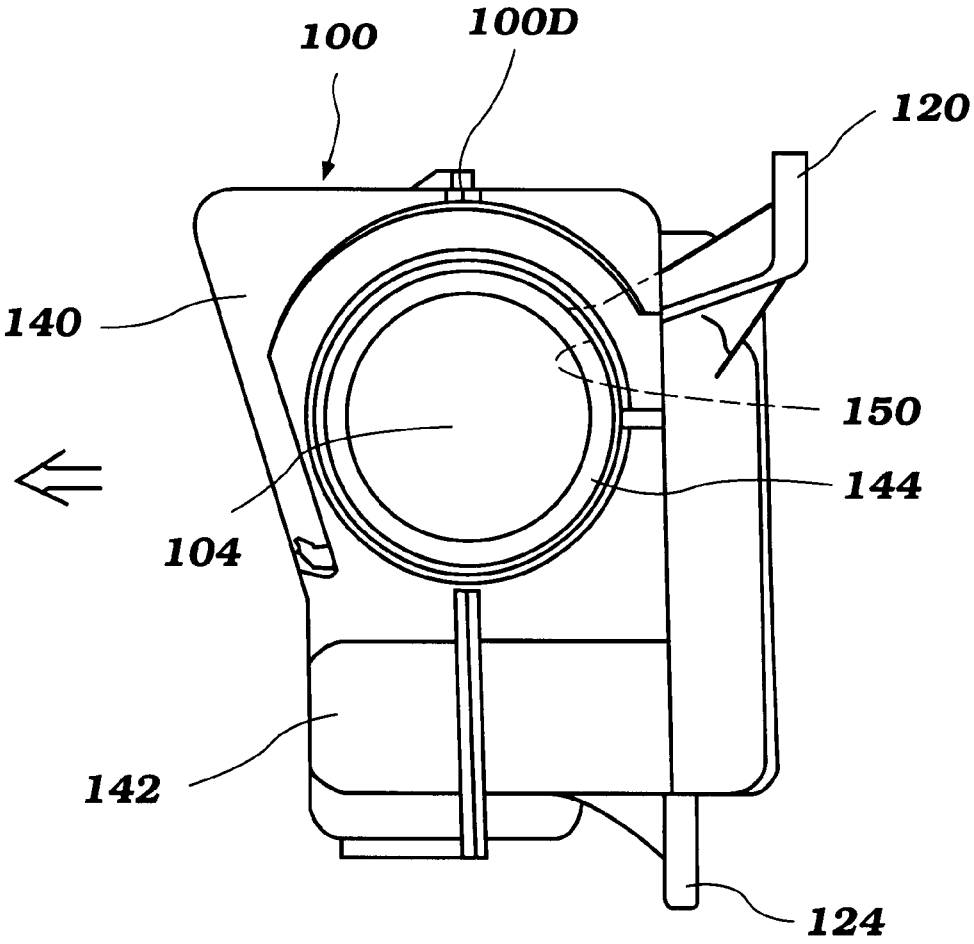
FIG. 8 is a side elevational view of the intake air chamber shown in FIG. 7.

With reference to FIGS. 6 and 7, the front and rear members 100A, 100B of the intake air chamber 100 preferably include a visor portion 140A, 140B, respectively. These visor portions 140A, 140B cooperate to form an upper visor 140 extending generally over the inlet 104 of the first intake air chamber 100. As such, dripping or splashing water that may fall towards the inlet 104 can be prevented from entering the intake air chamber 100.

As shown in FIGS. 7 and 10, the air intake chamber also preferably includes a, lower visor 142. In the illustrated embodiment, the lower visor 142 is formed of lower visor portion 142A and lower visor portion 142B formed on the outer and inner members 100A, 100B, respectively. As shown in FIG. 10, the lower portion 142 extends outwardly from the inlet 104 so as to further protect the inlet 104 from splashing water within the engine compartment 28.

With reference to FIGS. 8 and 10, a presently preferred embodiment of the intake air chamber 100 includes an air inlet sleeve 144 positioned in the inlet 104. In the illustrated embodiment, the inlet sleeve 144 is annular in shape and is sealedly engaged with the inlet 104 around its outer surface. In this embodiment, the outer surface of the inlet sleeve 144 includes an annular channel 146. Additionally, an inlet aperture 150, to which the channel is engaged, is defined by an inlet plate 148. The channel 146 engages the inner periphery of the aperture 150 to sealedly engage the outer periphery of the sleeve 144 with the plate 148.

The inlet sleeve 144 includes an external portion 152 which is trumpet-shaped and an internal portion 154 which extends into the interior of the intake air chamber 100. As such, the sleeve 144 aids in smoothing and quieting a flow of intake air into the air intake chamber 100.

Figure 9:
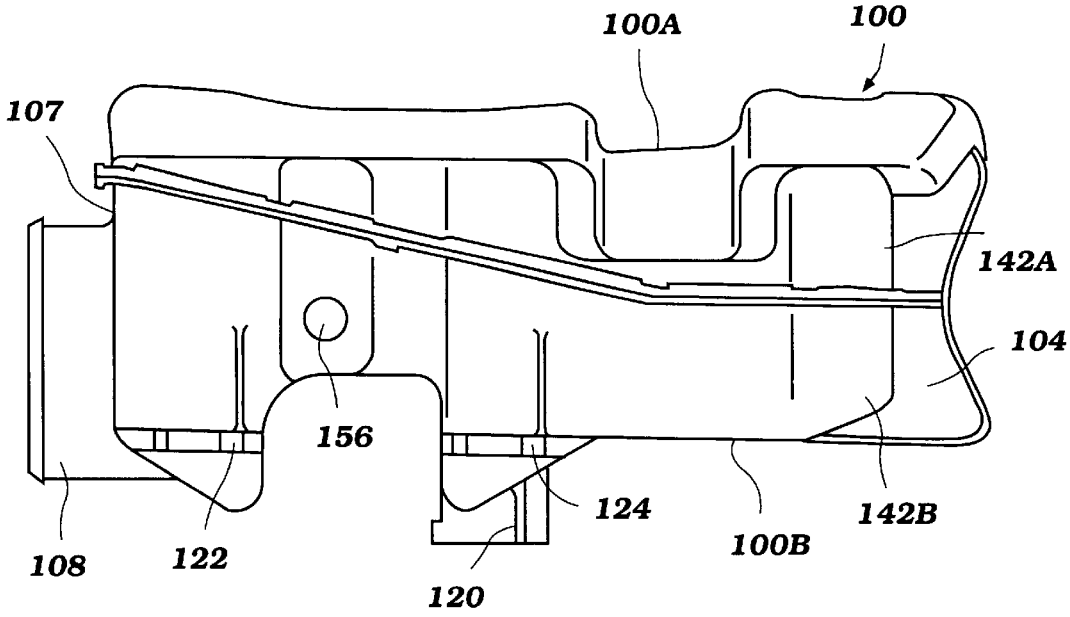
FIG. 9 is a bottom plan view of the intake air chamber shown in FIG. 8.

The intake air chamber 100 also preferably includes a drain 156, as shown in FIG. 9. The drain 156 is preferably provided within a recess 158, defined in a lower surface 160 of the interior of the intake air chamber 100. By providing the drain 156 within the recess 158, the intake air chamber 100 may be drained of water that may have inadvertently splashed into the orifice 104, thereby preventing the excessive buildup of water within the induction system 90, which may eventually be fed into the combustion chambers of the engine 32.

Preferably, the drain 156 is provided with a checkvalve 162 which is configured to allow water to drain from the intake air chamber 100. Alternatively, the drain 156 may be connected to an active sump system for removing water from the engine compartment 28 of the watercraft 10.

Also preferably, the outlet 108 of the intake air chamber 100 includes a rib 164 extending from a lower edge 166 of the outlet 108 and into the interior of the intake air chamber 100. Arranged as such, if an excessive amount of water has been accumulated in the interior of the intake air chamber 100, and is shifted violently during normal operation of the watercraft 10, the rib 164 reduces the likelihood that water may flow through the outlet 108 and into the conduit 102.

With reference to FIGS. 4 and 5, the induction system 90 preferably includes a branched intake air chamber 168 communicating with the air flow path of the induction system 90. In the illustrated embodiment, the branched intake air chamber 168 communicates with the conduit 102 through a branch conduit 170. Preferably, the chamber 168 and the conduit 170 are configured so as to form an Helmholtz resonator wherein the chamber 168 forms a resonator chamber and the conduit 170 forms a throat. As is known in the art, a Helmholtz resonator can be tuned so to provide sound attenuation over a desired sound range. Preferably, the chamber 168 and throat 170 are tuned to attenuate sound at about 360 Hz.

Figure 12:
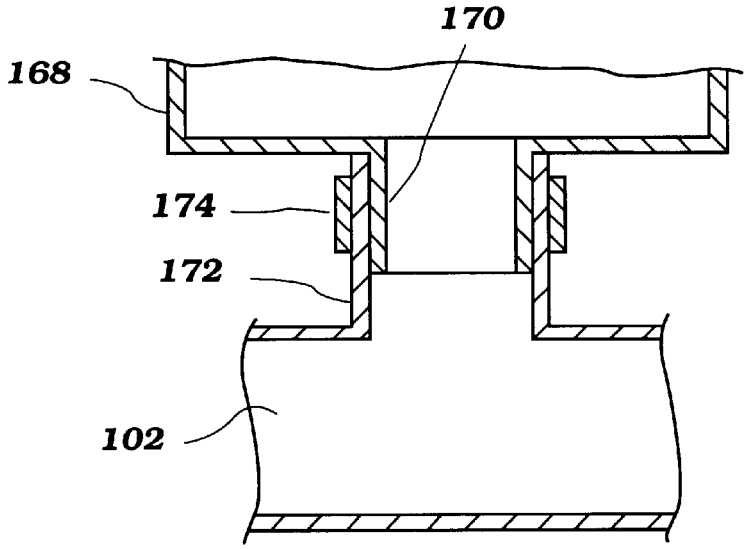
FIG. 12 is a cross-sectional view of the connection between the conduit and the resonator chamber shown in FIG. 4.

As shown in FIG. 4, the chamber 168 is preferably mounted so as to extend upwardly form the conduit 102. For example, as shown in FIG. 12, the throat 170 can be slip fit into a branch portion 172 of the conduit 102. A band 174 can be fit and/or tightened around the branch conduit 172 so as to sealedly engage the throat portion 170.

By arranging the chamber 168 so as to extend upwardly from the conduit 102, the chamber 168 further protects the engine from the influx of water. For example, small watercraft are sometimes capsized during operation. When such a watercraft, such as the watercraft 10, is capsized, any water in the air intake chamber 100 might flow upstream through the induction system 90 towards the intake runners 94, through the charge formers 96, and possibly into the combustion chambers defined within the cylinder block 42. However, water travelling from the air intake chamber 100 through the conduit 102, when the watercraft 10 is capsized, would be diverted into the chamber 168, since, when capsized, the chamber 168 would extend downwardly from the conduit 102. Thus, water can be temporarily trapped when the watercraft 10 is capsized and thus, prevented from reaching the first intake air chamber 92.

Additionally, when the watercraft 10 is righted, any water trapped in the chamber 168 will flow back into the conduit 102 and eventually lead the induction system 90 through the drain 156. Thus, by positioning the chamber 168 as such, the chamber 168 can collect water when the watercraft 10 is inverted and drain such water when the watercraft resumes its normal upright position.

Accordingly, although this invention has been described in terms of certain preferred embodiments, other embodiments apparent to those of ordinary skill in the art are also within the scope of this invention. Of course, a watercraft need not include all of these features to appreciate some of the aforementioned advantages associated with the present watercraft. Accordingly, the scope of the invention is intended to be defined only by the claims that follow.

What is claimed is:

1. An engine induction system for a watercraft comprised of a hull defining an engine compartment, an internal combustion engine having at least one combustion chamber and being supported within the engine compartment, and a propulsion device supported by the hull and driven by the engine to propel the hull, the induction system comprising a first intake air chamber having an air inlet and communicating with the at least one combustion chamber, a second intake air chamber having an air inlet and an air outlet, a conduit connecting the air inlet of the first intake air chamber to the outlet of the second intake air chamber, the outlet of the second intake air chamber being positioned vertically lower than the inlet of the first intake air chamber, and a branched passage extending upwardly from the conduit.

2. An engine induction system as set forth in claim 1, wherein the outlet of the second intake air chamber being positioned completely vertically lower than the inlet of the first intake air chamber.

3. An engine induction system as set forth in claim 1, wherein the outlet of the second intake air chamber includes an upper edge and the inlet of the first intake air chamber includes a lower edge positioned vertically higher than the upper edge of the outlet of the second intake air chamber.

4. An engine induction system as set forth in claim 1, wherein the conduit has a cross-sectional air flow area that is less than a maximum cross sectional flow area of the second chamber.

5. An engine induction system as set forth in claim 1, wherein the conduit has a cross-sectional air flow area that is larger that the outlet of the second intake air chamber.

6. An engine induction system as set forth in claim 5, wherein the cross-sectional air flow area of the conduit is larger that the inlet of the first intake air chamber.

7. An engine induction system as set forth in claim 1, wherein the conduit forms a third intake air chamber.

8. An engine induction system as set forth in claim 1, wherein the branched passage is configured to collect water flowing through the conduit when the watercraft is capsized and to drain the water back to the conduit when the watercraft is upright.

9. An engine induction system as set forth in claim 1, wherein the branched passage is configured to form a Helmholtz resonator.

10. An engine induction system as set forth claim 1, additionally comprising a trumpet-shaped inlet sleeve defining the inlet to the second intake air chamber.

11. An engine induction system for a watercraft comprised of a hull defining an engine compartment, an internal combustion engine having at least one combustion chamber and being supported with the engine compartment, and a propulsion device supported by the hull and driven by the engine to propel the hull, the induction system comprising a first intake air chamber having an air inlet and communicating with the at least one combustion chamber, a second intake air chamber having an air inlet and an air outlet, a conduit connecting the air inlet of the first intake air chamber to the outlet of the second intake air chamber, the conduit forming a third intake air chamber, and a branched passage extending upwardly from the conduit.

12. An engine induction system as set forth in claim 11, wherein the branched passage is configured to collect water flowing through the conduit when the watercraft is capsized and to drain the water back to the conduit when the watercraft is upright.

13. An engine induction system as set forth in claim 11, wherein the branched passage is configured to form a Helmholtz resonator.

14. An engine induction system for a watercraft comprised of a hull defining an engine compartment, an internal combustion engine having at least one combustion chamber and being supported within the engine compartment, and a propulsion device supported by the hull and driven by the engine to propel the hull, the induction system comprising a first intake air chamber having an air inlet and communicating with the at least one combustion chamber, a second intake air chamber having an air inlet and an air outlet, a conduit connecting the air inlet of the first intake air chamber to the outlet of the second intake air chamber, and a branched passage extending upwardly from the conduit.

15. An engine induction system as set forth in claim 14, wherein the branched passage is configured to collect water flowing through the conduit when the watercraft is capsized.

16. An engine induction system as set forth in claim 15, wherein the branched passage is configured to drain the water back to the conduit when the watercraft is upright.

17. An engine induction system as set forth in claim 15, wherein the branched passage is connected to the conduit via a throat.

18. An engine induction system as set forth in claim 15, wherein the branched passage and the throat are configured to form a Helmholtz resonator.

19. An engine induction system as set forth in claim 14, additionally comprising a trumpet-shaped inlet sleeve defining the inlet to the second intake air chamber.

20. An engine induction system for a watercraft comprised of a hull defining an engine compartment, an internal combustion engine having at least one combustion chamber and being supported within the engine compartment, and a propulsion device supported by the hull and driven by the engine to propel the hull, the induction system comprising a first intake air chamber having an air inlet and communicating with the at least one combustion chamber, a second intake air chamber having an air inlet and an air outlet, a conduit connecting the air inlet of the first intake air chamber to the outlet of the second intake air chamber, and means for collecting water from the induction system when the watercraft is capsized and for draining the collected water when the watercraft is upright.

21. An engine as set forth in claim 20, wherein the second intake air chamber includes a lower wall having a recess adjacent the outlet of the second intake air chamber, a drain port provided in the recess.

22. An engine as set forth in claim 21 additionally comprising a check valve provided in the drain port.

* * * * *